US009433821B2

(12) United States Patent
Kivinen

(10) Patent No.: US 9,433,821 B2
(45) Date of Patent: Sep. 6, 2016

(54) REST FOR SUPPORTING THE HEAD OR NECK

(76) Inventor: Aija Kivinen, Kuopio (FI)

( * ) Notice: Subject to any disclaimer, the term of this patent is extended or adjusted under 35 U.S.C. 154(b) by 0 days.

(21) Appl. No.: 14/376,300

(22) PCT Filed: Feb. 14, 2012

(86) PCT No.: PCT/FI2012/050137

§ 371 (c)(1),
(2), (4) Date: Aug. 1, 2014

(87) PCT Pub. No.: WO2013/121075

PCT Pub. Date: Aug. 22, 2013

(65) Prior Publication Data

US 2014/0371030 A1 Dec. 18, 2014

(51) Int. Cl.
*A63B 21/04* (2006.01)
*A63B 23/025* (2006.01)
(Continued)

(52) U.S. Cl.
CPC ..... *A63B 23/025* (2013.01); *A63B 21/00072* (2013.01); *A63B 21/153* (2013.01);
(Continued)

(58) Field of Classification Search
CPC ..... A63B 21/00003; A63B 21/00007; A63B 21/0001; A63B 21/00014; A63B 21/00029; A63B 21/00043; A63B 21/00069; A63B 21/00072; A63B 21/00076; A63B 21/0009; A63B 21/00094; A63B 21/00101; A63B 21/00109; A63B 21/0012; A63B 21/00123; A63B 21/00127; A63B 21/0013; A63B 21/00134; A63B 21/00141; A63B 21/00178; A63B 21/00181; A63B 21/002; A63B 21/0026; A63B 21/012; A63B 21/0125; A63B 21/015; A63B 21/018; A63B 21/02; A63B 21/023; A63B 21/025; A63B 21/04; A63B 21/0407; A63B 21/0414; A63B 21/0421; A63B 21/0428; A63B 21/0435; A63B 21/0442; A63B 21/045; A63B 21/0455; A63B 21/055; A63B 21/0552; A63B 21/0555; A63B 21/0557; A63B 21/065; A63B 21/08; A63B 21/1407; A63B 21/1446; A63B 21/1449; A63B 21/1457; A63B 21/1461; A63B 21/1465; A63B 21/1469; A63B 21/1476; A63B 21/1484; A63B 21/1488; A63B 21/1492; A63B 21/1496; A63B 21/15; A63B 21/151; A63B 21/152; A63B 21/153; A63B 21/157; A63B 21/16; A63B 2021/1609; A63B 2021/1672; A63B 23/025; A63B 23/035; A63B 23/03508; A63B 23/03516; A63B 23/03533; A63B 23/03541; A63B 23/12; A63B 23/1209; A63B 23/1245; A63B 23/1254; A63B 23/1263; A63B 23/1272; A63B 23/1281; A63B 2023/006; A63B 2208/0228; A63B 2208/0233; A63B 2208/0252; A63B 2210/02; A63B 2210/04; A63B 2210/50; A63B 2210/58
See application file for complete search history.

(56) References Cited

U.S. PATENT DOCUMENTS 3,529,820 A * 9/1970 Templeton ..... A63B 21/0004 482/122
3,687,450 A 8/1972 Schollmeyer
(Continued)

FOREIGN PATENT DOCUMENTS

CN 2595406 Y 12/2003
DE 2908545 A1 5/1980
(Continued)

OTHER PUBLICATIONS

Extended European Search Report. App No./Patent No. 12868842. 1-2814581 PCTFI2012050137. Date Sep. 28, 2015.

*Primary Examiner* — Oren Ginsberg
*Assistant Examiner* — Gary D Urbiel Goldner
(74) *Attorney, Agent, or Firm* — Ziegler IP Law Group LLC

(57) ABSTRACT

A rest for supporting the head or neck of a user, the rest accommodating one or more rotatable reels, each of the one or more reels configured with a pulling member, such as a cable or the like, a mechanism configured for rotating the one or more rotatable reels; handles connected to each pulling member, the handles located on sides of the rest and configured for a pulling movement of each pulling member; and a resistance provided in the rest for adjusting the force of the pulling movement required by each pulling member.

7 Claims, 4 Drawing Sheets

(51) Int. Cl.
*A63B 21/00* (2006.01)
*A63B 23/00* (2006.01)
*A63B 23/12* (2006.01)

(52) U.S. Cl.
CPC ..... *A63B21/1609* (2015.10); *A63B 21/4003* (2015.10); *A63B 21/4023* (2015.10); *A63B 21/4035* (2015.10); *A63B 21/0414* (2013.01); *A63B 23/12* (2013.01); *A63B 2023/006* (2013.01); *A63B 2208/0233* (2013.01); *A63B 2208/0242* (2013.01); *A63B 2208/0252* (2013.01)

(56) References Cited

U.S. PATENT DOCUMENTS 3,893,667 A 7/1975 Snyder, Jr.
4,335,875 A * 6/1982 Elkin ..... A63B 69/0059 482/131
4,691,917 A * 9/1987 Battista ..... A63B 23/12 482/131
4,789,154 A 12/1988 Mattox
4,921,242 A 5/1990 Watterson
4,921,247 A * 5/1990 Sterling ..... A63B 17/00 482/130
5,044,633 A * 9/1991 Rice ..... A63B 21/04 482/130
5,141,482 A * 8/1992 Hern ..... A63B 21/0552 482/123
5,147,265 A 9/1992 Pauls et al.
5,362,296 A * 11/1994 Wang ..... A63B 21/04 482/121
5,514,059 A * 5/1996 Romney ..... A63B 21/0004 482/121
5,681,248 A * 10/1997 Vani ..... A63B 21/0004 482/10
5,755,650 A 5/1998 Urso
5,857,948 A * 1/1999 Barnett ..... A63B 21/0004 482/140
6,013,014 A * 1/2000 Hern ..... A63B 21/0552 482/121
6,120,423 A * 9/2000 Mackey ..... A63B 21/025 482/121
6,159,133 A 12/2000 Shugg
6,179,747 B1 * 1/2001 Kelley ..... A63B 23/025 482/10
6,183,403 B1 * 2/2001 Dunn ..... A63B 21/0552 482/121
6,244,998 B1 * 6/2001 Hinds ..... A63B 21/0004 482/124
6,921,357 B2 * 7/2005 Basting ..... A63B 21/0004 482/121
7,083,555 B1 * 8/2006 McPartland ..... A63B 21/0552 297/464
7,618,356 B1 11/2009 Johnson et al.
7,803,094 B1 9/2010 Bolick, Jr.
7,935,036 B2 * 5/2011 Haynes ..... A63B 21/1449 482/121
8,029,425 B2 * 10/2011 Bronston ..... A63B 21/02 482/123
8,632,443 B2 * 1/2014 Hauptmann ..... A63B 21/1484 482/121
9,079,062 B2 * 7/2015 Thomas ..... A63B 21/0442
2003/0134728 A1 7/2003 Wu
2004/0058789 A1 * 3/2004 Tsai ..... A63B 21/025 482/115
2004/0072660 A1 4/2004 Mercuri et al.
2004/0254049 A1 * 12/2004 Martien ..... A63B 21/008 482/121
2005/0215400 A1 * 9/2005 Nerenberg ..... A63B 21/02 482/123
2008/0026922 A1 * 1/2008 Smith ..... A63B 21/025 482/124
2010/0041526 A1 * 2/2010 Bowser ..... A63B 21/04 482/123
2010/0144492 A1 * 6/2010 Ruan ..... A63B 21/0552 482/10
2011/0009248 A1 1/2011 Bronston
2012/0322633 A1 * 12/2012 Holman ..... A63B 21/028 482/123

FOREIGN PATENT DOCUMENTS

DE 102006013366 A1 9/2007
EP 2353660 A1 8/2011
WO 2007148333 A3 12/2007

* cited by examiner

REST FOR SUPPORTING THE HEAD OR NECK

FIELD

The invention relates to a rest for supporting head or neck.

BACKGROUND

Nowadays, people spend much time sitting during working hours and free time. The amount of exercising is often quite small. For this other reasons, painful conditions and disorders of the musculoskeletal system are very common.

Some people work out actively and take different forms of exercise. Going to gyms and using the gym devices is one way to stress one's body and muscles. The problem often is that a person does not have enough time to work out, or going outdoors or to work out is experienced to be difficult. There exist workout instruments for use at homes, but such instruments are not widely used.

Publications U.S. Pat. No. 6,159,133 A and DE 10 2006 013 366 A1 disclose a chair with a workout mechanism integrated under the chair or to the back of the chair. These mechanisms are complex and take up a great deal of space and must be taken into account already in designing and making the chair.

SUMMARY

Now a rest has been invented for supporting the head or neck, which rest is applicable for workout alongside other activities e.g. while sitting or lying down. The rest according to the invention for supporting the head or neck is simple, compact and structurally functional.

Now a rest has been invented for supporting the head or neck, accommodating one or more rotatable reels with pulling members, such as cables or the like, a mechanism for rotating the reel or reels, and handles connected to the pulling members on the sides of the rest for pulling the pulling member or pulling members, and the rest accommodates a resistance for adjusting the force of the pulling movement required by the pulling member.

The rest according to the invention accommodates one or more rotatable reels with pulling members, such as cables, a mechanism for rotating the reel or reels, and handles connected to the pulling members on the sides of the rest for pulling the pulling member. The handles are preferably removably attached to the rest and can be easily removed, utilized and then attached in position as desired. The handles can be shaped in different ways for different embodiments, but it is good to bear in mind the anatomy of the human hand in shaping the handles.

In one embodiment of the invention, the rest accommodates a resistance for adjusting the force of the pulling movement required by the pulling member. By adjusting the resistance, the force resisting the movement of the pulling member, i.e. the use of force required by the exercises, can be adjusted as desired. The resistance adjustment mechanism is generally arranged to adjust the reels simultaneously.

In one embodiment of the invention, the rest is a neck rest. Such a rest is placed behind the neck and attached e.g. to a seat, chair or the like as desired. When the rest is used as a workout instrument, the handles can be removed from the rest.

In one embodiment of the invention, the rest is a neck rest for use in vehicles. In this case, the driver of the vehicle and the passenger of the vehicle can work out and flex by means of the device provided in the rest during the drive, and the workout takes place almost without noticing and does not take up more of one's free time.

In one embodiment of the invention, the adjustment device of the rest includes a locking member for preventing the rest from being used while the vehicle is moving. The reels can be locked in such a way as not to open the locking until the vehicle stops and, respectively, to lock the reels as the vehicle starts moving. In this case, the driver of the vehicle cannot use the instrument while the vehicle is moving. Such a function is not necessarily needed for the neck rests of other seats.

In one embodiment of the invention, the rest is a pillow. In this case, a person resting e.g. on a bed or couch can use the instrument while lying down. This is applicable for use in a hospital and for rehabilitation as well as for home workout. Such a pillow is easy to move from one place to another and includes the workout mechanism according to the invention integrated in the pillow.

BRIEF DESCRIPTION OF THE DRAWINGS

Below, the invention is explained by way of example with reference to the accompanying drawings, in which.

DESCRIPTION OF THE DISCLOSED EMBODIMENTS

Figure 1:
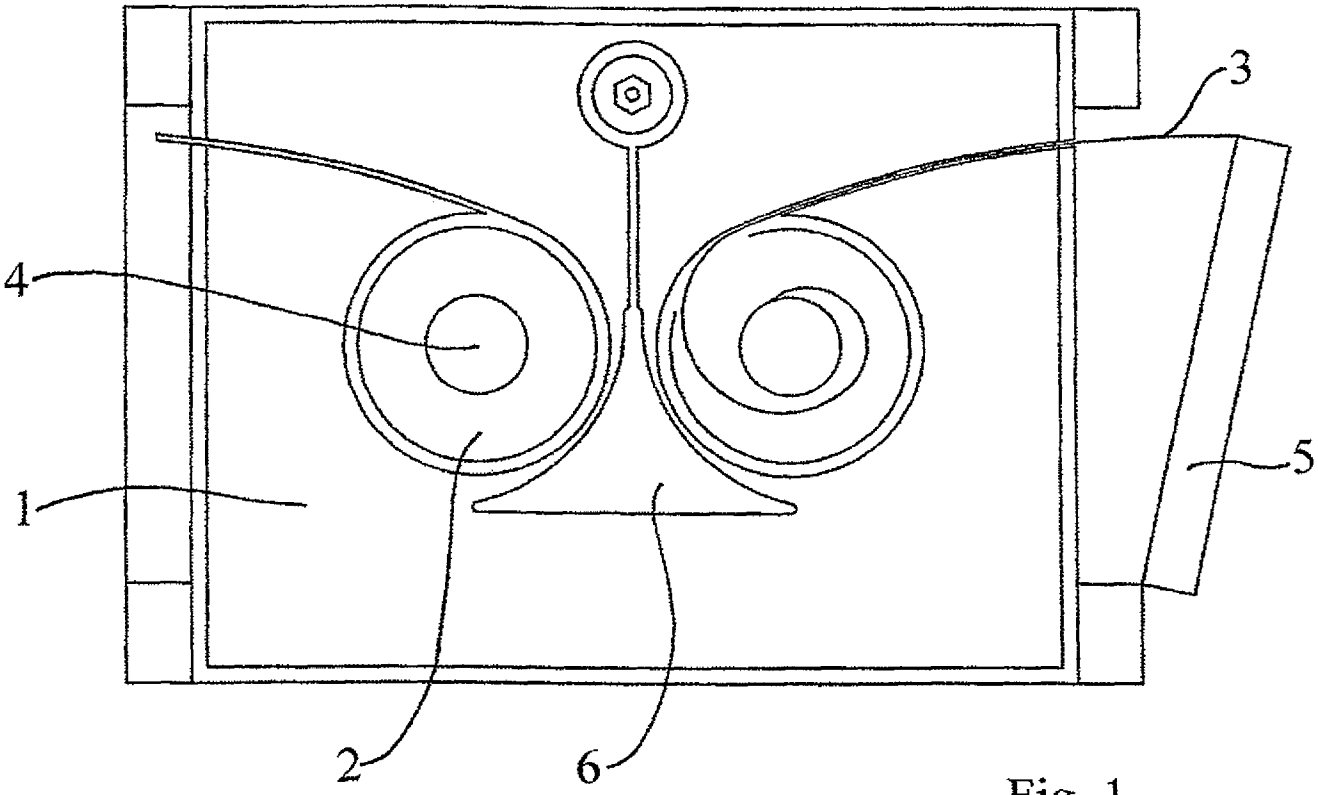
FIG. 1 illustrates one rest according to the invention in cross section.

FIG. 1 illustrates the structure inside one rest according to the invention. In this FIG. 1, two rotatable reels 2 are provided inside the rest 1. Pulling members 3, which are cables in this connection, are wound about the reels. A handle 5 attached to the pulling member is provided on both sides of the rest for pulling the pulling member. The handles are provided and attached to the edges of the rest in such a way that they are easily removable and, respectively, easily mountable. In this embodiment, the handles constitute a part of the structure of the edge of the rest. The sides of the rest may have recesses to house the handles and stow them when not used for workout. A spring-operated mechanism 4 is provided for the reels of the rest and arranged to rotate the reel and pull back the cable. The spring-operated mechanism resists pulling to a degree; however, a separate resistance 6 is provided in the rest with a resistance adjuster for adjusting the force of the pulling movement required by the pulling member. The resistance adjuster is arranged to affect the rotation of the reel. In this embodiment, the resistance is a wedge-shaped element by means of which the reel mechanics can be steplessly adjusted by moving the resistance closer to the reels. The resistance adjustment element may be provided on the back of the neck rest (not shown in the figure) to allow the user manually to adjust the resistance force. The resistance may be implemented by a mechanism where it produces resistance as the cable is pulled out and where it releases the resistance e.g. by a specific movement (e.g. as the cable is raised up in the operating position of the rest) or when sensing the inward movement of the cable. This ensures that the cable is wound in and that the resistance would not prevent the winding in of the cable. Cushions may be provided outside the rest so that it would be comfortable against the neck and/or head.

Figure 2B:
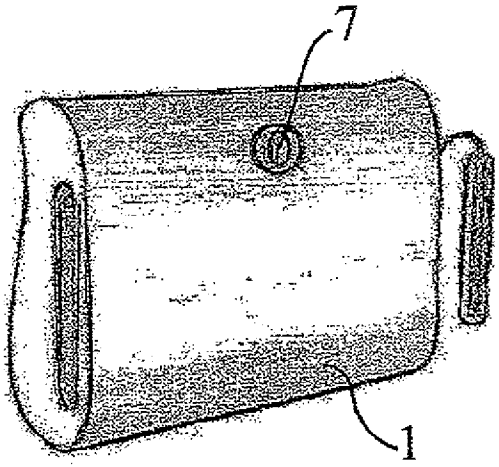
FIGS. 2*a* and 2*b* illustrate one neck/head rest according to the invention viewed diagonally from the front and diagonally from the back.
Figure 2A:
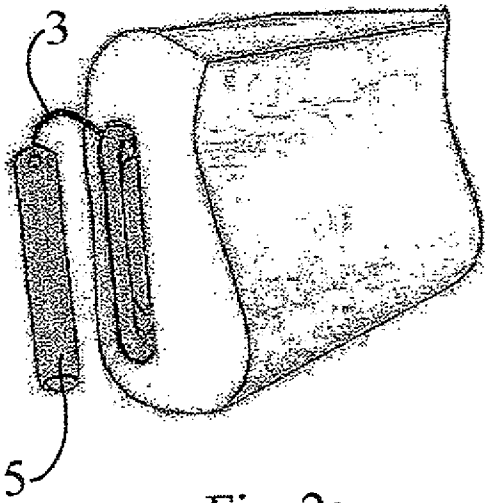

The rest 1 illustrated in FIGS. 2*a* and 2*b* is a neck rest which can be attached to a desired product such as a chair. It can be attached to the chair fixedly or removably. The rest according to FIGS. 2*a* and 2*b* may also be a separate pillow held under the head while lying down and sleeping. In this case, the rest according to the invention can be used for workout while lying down, e.g. on the floor or in the bed. The interior of the rest accommodates elements and parts corresponding to those in the rest according to FIG. 1. The front part of the rest is shaped for the purpose of supporting the neck. The sides of the rest are provided with handles attached to pulling members and being mountable into recesses on the sides of the rest. A spring mechanism is provided in the recesses to force out the handle when being gently pushed, which allows effortless and easy use of the workout instrument. The handle is attached to the cable by a ball joint. The ball joint allows keeping the wrist in an ergonomic position in all situations. A resistance adjustment member, i.e. an adjustment knob 7, is provided on the back of the neck rest.

Figure 3A:
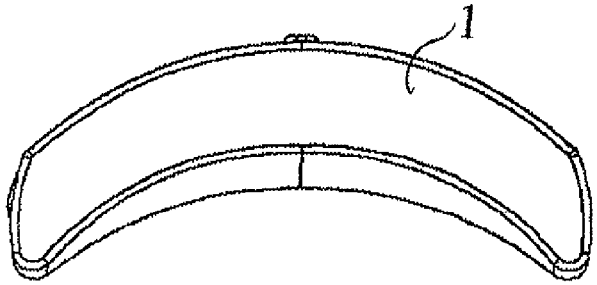
FIGS. 3*a* and 3*b* illustrate a second neck rest according to the invention viewed from the top and diagonally from the side.
Figure 3B:
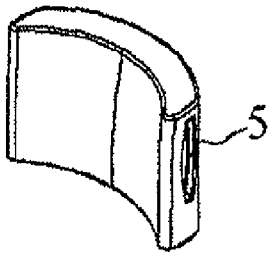

The rest illustrated in FIGS. 3*a* and 3*b* is a neck rest for use in vehicles. The rest illustrated in FIGS. 3*a* and 3*b* is slightly curved in shape, and on the site of the neck it has a thicker section providing the neck with the best possible rest. Handles are provided in side recesses and can be removed from their spring locking and utilized by pushing gently. The locking remains closed when the vehicle is moving. In addition, the locking prevents falling off of the handles in a collision situation. The locking of the handles to the neck rest can also be carried out electronically, e.g. by means of motion detectors. When sensed by the motion detectors that the car is moving, the locking can prevent the handles from being removed from the recesses. This ensures safety for the driver so that the workout instrument cannot be used while the car is moving and prevents falling off of the handles in a collision situation. Another alternative is to provide a connection between the neck pad and the speedometer. This can be effected e.g. by providing the neck pad with Bluetooth or other wireless communication circuit connected to the speedometer of the car and, as in the case of motion detectors, preventing the falling off and removal of the handles when the car is moving.

Figure 4A:
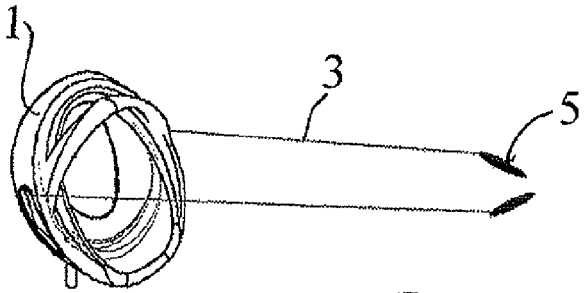
FIGS. 4*a*, 4*b* and 4*c* illustrate a third neck rest according to the invention viewed diagonally from the front, directly from the front and directly from the side.
Figure 4C:
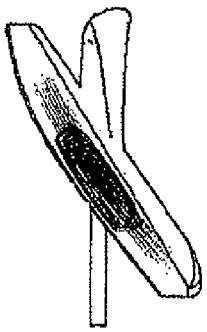
Figure 4B:
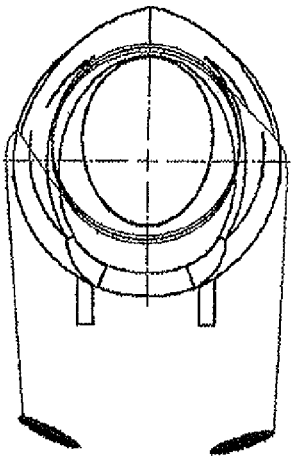
Figure 5:
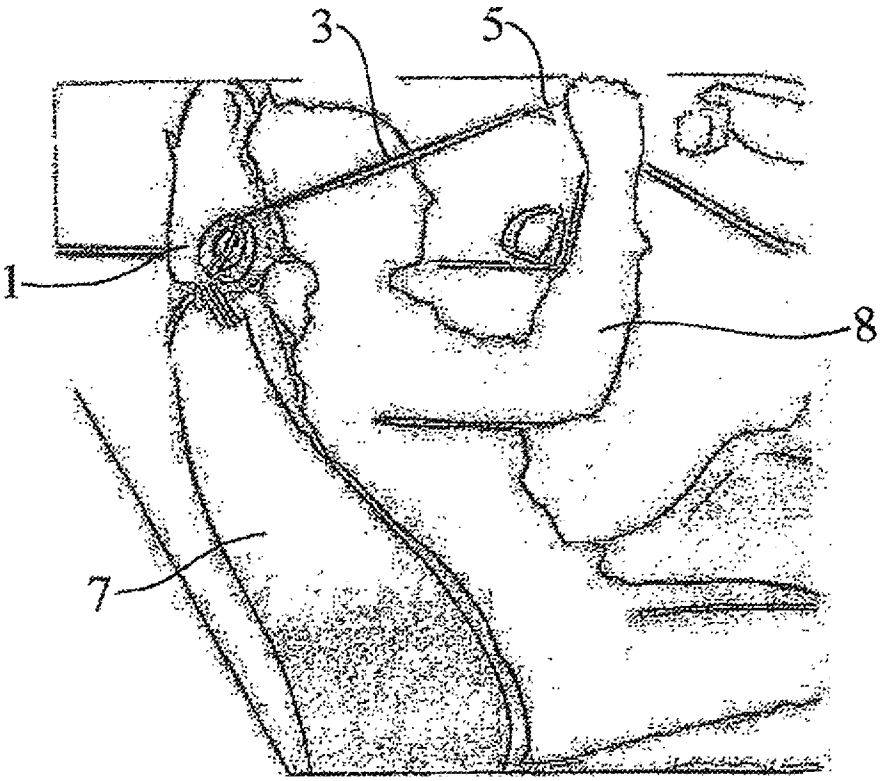
FIG. 5 illustrates an exemplary use of the neck rest of the disclosed embodiments.

The rest illustrated in FIGS. 4*a* and 4*b* is also designated as a neck rest for use in a vehicle. It has, inside the rest, one large reel combining two reels with the cable moving in different directions. The large reel is provided inside the entire circular part of the rest. Such a solution allows a modern open design while providing a workout mechanism for the neck rest. The center of the neck rest thus has an opening and, in terms of shape, the neck rest resembles a doughnut where the reels about which the cable is wound are provided inside the doughnut-shaped neck rest.

The structure of the rest according to the invention may vary as desired in different embodiments of the invention. The reels may be provided inside the rest either side by side or one on top of the other. If provided one on top of the other, they take up less space in the lateral direction of the rest.

One embodiment of the rest according to the invention is a rehabilitating neck pad designated for rehabilitation and hospital use and exemplified in FIGS. 2*a* and 2*b*. The neck pad is a softish product made e.g. from plastic or other material. It may have a cellular structure to make its use comfortable in a recumbent or semirecumbent position. The air flowing through the cellular structure adds to the comfort of using the product. The neck pad has a structure as described above where a reel mechanism is provided inside the neck pad and handles are buried in recesses on the sides of the neck pad, the recesses being sufficiently large to allow utilization of the handles as easily as possible. The handles and the cover of the neck pad are easily removable for cleaning purposes. The materials are hygienic and easy-care. Such a neck pad may be a separate pad or may be attached to the bed at a desired site, such as at an end or sides, or around the mattress, by means applicable for the purpose such as adjustable straps.

The rest according to the invention for supporting the head or neck is a compact integrated solution where the entire workout mechanism is integrated inside the rest as part of the rest. This allows the rest to be carried around. The compact, integrated solution also allows placement of the rest to an existing chair or seat, e.g. a car seat, as a retrofitted neck rest.

The invention is not limited to the embodiments described above; instead, it may vary within the scope of the claims.

The invention claimed is:

1. A rest for supporting head or neck of a user, in particular a neck rest for a chair, seat, or a neck pad, the rest comprising at least two rotatable reels, each of the at least two rotatable reels configured with pulling members; a spring-operated mechanism configured for rotating the at least two rotatable reels; on sides of the rest, handles connected to each pulling member, the handles configured for a pulling movement of each pulling member; and a resistance and a resistance adjuster provided in the rest for allowing the user to adjust the force of the pulling movement required by the pulling member, wherein the resistance adjuster is configured to adjust the resistance of each of the at least two reels simultaneously.

2. The rest according to claim 1, wherein the rest is a neck rest for use in a vehicle.

3. The rest according to claim 2, wherein the rest has a locking member for preventing the rest from being used while the vehicle is moving.

4. The rest according to claim 1, wherein the rest is a pillow.

5. The rest according to claim 1, wherein the rest further comprises outer cushions, and the at least two rotatable reels, each pulling member and the resistance are integrated inside the rest.

6. The rest according to claim 1, wherein the sides of the rest have recesses fitted to receive the handles.

7. The rest according to claim 1, wherein each pulling member is a cable.

* * * * *